US006786716B1

(12) United States Patent
Gardner et al.

(10) Patent No.: US 6,786,716 B1
(45) Date of Patent: Sep. 7, 2004

(54) MICROCOMBUSTOR

(75) Inventors: Timothy J. Gardner, Albuquerque, NM (US); Ronald P. Manginelli, Albuquerque, NM (US); Patrick R. Lewis, Albuquerque, NM (US); Gregory C. Frye-Mason, Stillwater, OK (US); Chris Colburn, Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 0 days.

(21) Appl. No.: 10/369,442

(22) Filed: Feb. 18, 2003

Related U.S. Application Data

(60) Provisional application No. 60/358,250, filed on Feb. 19, 2002.

(51) Int. Cl.[7] ..... F23Q 11/00

(52) U.S. Cl. ..... 431/268; 431/350; 431/75

(58) Field of Search ..... 431/268, 354, 431/350, 75, 25, 24, 7, 170, 328; 340/579; 60/723, 737; 219/260, 270, 385, 538, 542, 544

(56) References Cited

U.S. PATENT DOCUMENTS

| | | | | |
|---|---|---|---|---|
| 4,335,298 A | * | 6/1982 | Newbold, Jr. | 219/544 |
| 4,534,728 A | * | 8/1985 | Vogels | 431/25 |
| 5,403,184 A | * | 4/1995 | Hosaka et al. | 431/268 |
| 6,171,378 B1 | | 1/2001 | Manginell et al. | 96/143 |
| 6,193,501 B1 | | 2/2001 | Masel et al. | 431/268 |
| 6,446,426 B1 | * | 9/2002 | Sweeney et al. | 431/7 |

FOREIGN PATENT DOCUMENTS

JP 2001-99798 A * 4/2001

OTHER PUBLICATIONS

Cohen et al., "Microcombustor and Combustion–Based Thermoelectric Microgenerator", U.S. patent application No. 2001/0029974, filed Jan. 5, 2001.

Mowry, et al., "Micropyrolyzer for Chemical Analysis of Liquid and Solid Samples", patent application No. 10/035, 537, filed Oct. 23, 2001.

Srinivasan et al., "Micromachined chemical reactors for surface catalyzed oxidation reactions," Tech. Digest 1996 Sol. State *Tech. Digest 1996 Sol.–State Sensor and Actuator Workshop*, Transducers Research Foundation, Cleveland (1996) pp. 15–18.

L.R. Arana et al., "A microfabricated suspended–tube chemical reactor for fuel processing," *MEMS 2002*, Las Vegas, NV, Jan. 20–24, 2002, pp. 232–235.

M. Gall, "The Si–planar–pellistor array, a detection unit for combustible gases," *Sensors and Actuators B 15–16*, 260 (1993).

(List continued on next page.)

*Primary Examiner*—Josiah Cocks
(74) *Attorney, Agent, or Firm*—Kevin W. Bieg

(57) ABSTRACT

A microcombustor comprises a microhotplate and a catalyst for sustained combustion on the microscale. The microhotplate has very low heat capacity and thermal conductivity that mitigate large heat losses arising from large surface-to-volume ratios typical of the microdomain. The heated catalyst enables flame ignition and stabilization, permits combustion with lean fuel/air mixtures, extends a hydrocarbon's limits of flammability, and lowers the combustion temperature. The reduced operating temperatures enable a longer microcombustor lifetime and the reduced fuel consumption enables smaller fuel supplies, both of which are especially important for portable microsystems applications. The microcombustor can be used for on-chip thermal management and for sensor applications, such as heating of a micro gas chromatography column and for use as a micro flame ionization detector.

25 Claims, 10 Drawing Sheets

OTHER PUBLICATIONS

R.P. Manginell et al., "Selective, pulsed CVD of platinum on microfilament gas sensors," *Tech. Digest 1996 Sol.–State Sensor and Actuator Workshop*, Transducers Research Foundation, Cleveland (1996) 23–27.

R. E. Cavicchi et al., "Microhotplate gas sensor," *Tech. Digest 1994 Sol.–State Sensor and Actuator Workshop*, Transducers Research Foundation, Cleveland (1994) 53–56.

M. Zanni et al., "Fabrication and properties of a SI–based high sensitivity microcalorimetric gas sensor," *Tech. Digest 1994 Sol.–State Sensor and Actuator Workshop*, Transducers Research Foundation, Cleveland (1994) 176–179.

Zimmerman et al., "Micro flame ionization detector and micro flame spectrometer," *Sensors and Actuators B 63*, 159 (2000).

Zimmerman et al., "Miniaturized flame ionization detector for gas chromatography," *Sensors and Actuators B 83*, 285 (2002).

Frye–Mason et al., "Hand–Held Miniature Chemical Analysis System ($\mu$ChemLab) for Detection of Trace Concentrations of Gas Phase Analytes," *Micro Total Analysis Systems 2000*, 229 (2000).

M. M. Ohadi et al., "High temperature heat exchangers and microscale combustion systems: applications to thermal system miniaturization," *Experimental Thermal and Fluid Science 25*, 207 (2001).

Holm, "Aspects of the mechanism of the flame ionization detector," *J. Chromatography A 842*, 221 (1999).

Mathew Moorman et al., "Microcombustor array and micro–flame ionization detector for hydrocarbon detection," presented at SPIE MEMS Components and Applications Conference, Jan. 25–31, 2003, San Jose, CA.

* cited by examiner

MICROCOMBUSTOR

RELATED INVENTION

This application claims the benefit of Provisional Application No. 60/358,250, filed on February 19, 2002.

STATEMENT OF GOVERNMENT INTEREST

This invention was made with Government support under contract no. DE-AC04-94AL85000 awarded by the U.S. Department of Energy to Sandia Corporation. The Government has certain rights in the invention.

FIELD OF THE INVENTION

The present invention relates to a microcombustor for on-chip thermal management and sensor applications.

BACKGROUND OF THE INVENTION

Most Microsystems currently use macroscopic power supplies and energy sources that are external to the Microsystems device. However, the use of macroscopic power supplies places severe limitations on the functionality of Microsystems for many applications. Therefore, a microsystem comprising an integrated; compact, and flexible power supply is highly desirable. Such an integral microscale power supply would typically need to store energy at a high density and discharge the stored energy at a high rate. A number of microscale power supply concepts have been considered, including microcombustors, electrochemical batteries, fuel cells, storage in magnetic or electric fields, storage as elastic strain energy, etc.

Microcombustors are becoming increasingly important for microsystems applications. Such microcombustors may be useful as Microsystems power supplies, for example, to convert chemical energy to electricity via thermoelectric or thermophotovoltaic generators or to produce hydrogen for fuel cells. In addition, the development of a small and stable on-chip microcombustor would permit the adaptation or translation of several very useful macroscopic devices into the microsystem domain, including on-chip flame ionization detectors (microFiDs), microreactors, micropropulsion, energy conversion and, importantly, heating and thermal management of microsystems. Microcombustors offer several advantages over other microscale power supply concepts for these applications. Microcombustion systems can provide on-demand, instantaneous power. Furthermore, hydrocarbon fuels offer approximately order of magnitude greater energy storage per mass than batteries. For example, the energy density of butane, including storage cylinder mass, is 50 times that of the best high-output batteries (e.g., nonrechargable $LiMnO_2$ batteries). Hydrocarbon fuels are cheap and readily available and may present fewer environment concerns than batteries. Thus, a tiny fuel tank could replace several bulky batteries in hand-held microanalytical systems and could supply a microcombustor for efficient heating of essential components in a microsystem.

To sustain combustion in a microcombustor, the reactants must remain in the combustion chamber long enough to react and the temperature must not exceed the structural limits of the microcombustor materials. Reaction and residence times are effected by the choice of fuel, the fuel-to-air ratio, the size and geometry of the combustion chamber, and the gas-flow rate through the microcombustor. The scalability of combustion systems can be limited due to the increased surface-to-volume ratio at small combustor dimensions. In particular, thermal quenching due to heat losses to the walls and chemical quenching of reactive free radicals at surfaces become problematic as the dimensions of the combustor decrease, thereby limiting propagation of the combustion flame.

Prior art microcombustors having millimetric dimensions have been developed for power generation for microsystem devices. Cohen et al. in U.S. patent application Ser. No. 2001/0029974, discloses a microcombustor that relies on a toroidal counterflow heat exchanger to reduce heat loss from the combustor and to preheat the reactant gases. This microcombustor uses an external heater or an igniter internal to the heat exchanger to ignite combustion and is further configured with a thermoelectric material to generate electrical current. Masel et al., in U.S. Pat. No. 6,193,501, discloses a microcombustor having a combustion chamber that uses catalysts to get the reactants hot, ignited, and burning. Thermal barriers and an isolation cavity are used to minimize heat loss from a serpentine combustion chamber. Neither of these microcombustors use a microhotplate to minimize heat loss from the combustion chamber.

Microhotplates have been developed for micro-chemical reactors for partial oxidation synthesis and hydrogen reforming and for gas sensing. However, such microhotplates have typically been used to promote or sense reactions at the surface of the microhotplate and not to generate self-propagating combustion flames. See R. Srinivasan et al., "Micromachined chemical reactors for surface catalyzed oxidation reactions," *Tech. Digest* 1996 *Sol.-State Sensor and Actuator Workshop*, pp. 15–18 (1996); L. R. Arana et al., "A microfabricated suspended-tube chemical reactor for fuel processing," *MEMS* 2002, pp. 232–235 (2002); M. Gall, "The Si-planar-peilistor array, a detection unit for combustible gases," *Sensors and Actuators B*16. 260 (1993); R. P. Manginell et al., "Selective, pulsed CVD of platinum on microfilament gas sensors," *Tech. Digest* 1996 *Sol-State Sensor and Actuator Workshop*, pp. 23–27 (1996); R. E. Cavicchi et al., "Microhotplate gas sensor," *Tech. Digest* 1994 *Sol.-State Sensor and Actuator Workshop*, pp. 53–56 (1994); and M. Zanni et al., "Fabrication and properties of a Si-based high sensitivity microcalorimetric gas sensor," *Tech. Digest* 1994 *Sol.-State Sensor and Actuator Workshop*, pp. 176–179 (1994).

Finally, microFID systems created by other groups have used micromachined nozzles to anchor an oxyhydrogen diffusion flame, which is essentially a miniaturization of existing technology. Zimmerman et al., "Micro flame ionization detector and micro flame spectrometer," *Sensors and Actuators B* 63, 159 (2000) and Zimmerman et al., "Miniaturized flame ionization detector for gas chromatography," *Sensors and Actuators B* 83, 285 (2002) describe a miniaturized flame ionization detector that comprises a micro burner unit with a nozzle diameter of less than 100 $\mu$m to produce a stable miniature flame. Oxyhydrogen flow rates on the order of 35 ml/min were required for flame stabilization in this design.

There remains a need for an integrated, flexible, and efficient microcombustor that can be used for power generation, heating and thermal management of on-chip Microsystems, and for other sensor applications. Unlike the prior art, the present invention satisfies this need by providing a microcombustor comprising a microhotplate with a very low heat capacity and thermal conductivity to minimize heat loss from the combustion chamber and a surface catalyst for flame ignition and stabilization.

SUMMARY OF THE INVENTION

The microcombustor of the present invention combines a microhotplate and catalyst materials for sustained combustion on the microscale. The microhotplate comprises a thin-film heater/thermal sensor patterned on a thin insulating support membrane that is suspended from its edges over a substrate frame. This microhotplate has very low heat capacity and thermal conductivity and is an ideal platform for heating catalytic materials placed on the surface of the support membrane. The free-standing platform used in the microcombustor mitigates large heat losses arising from large surface-to-volume ratios typical of the microdomain, and, together with the heated catalyst, permits combustion on the microscale.

The heated catalyst enables flame stabilization, even in spaces with large surface/volume ratios; permits combustion with lean fuel/air mixtures; extends a hydrocarbon's limits of flammability; and lowers the combustion temperature. Surface oxidation, flame ignition, and flame stabilization have been achieved for hydrogen and hydrocarbon fuels premixed with air. Flame stabilization via catalytic surfaces permits stable combustion at hydrogen flows less than 5 ml/min and under lean conditions. In addition to providing for stable flames in the microdomain, the microcombustor expands the limit of flammability (LoF) for many hydrocarbon fuels, as compared with diffusion flames. For example, the LoF of the microcombustor for natural gas in air is 1–35%, as compared to the 4–16% typically observed. The LoF for hydrogen, methane, propane and ethane are likewise expanded. This expanded LoF has important consequences for microanalytical systems: not only is the energy density of combustible gases relatively high, but the microcombustor also allows for lean burning at low flows and at temperatures less severe than with diffusion flames. The reduced operating temperatures enable a longer system lifetime and the reduced fuel consumption enables smaller fuel supplies, both of which are especially important for portable applications.

The microcombustor can be used for on-chip thermal management of Microsystems. The microcombustor of the present invention provides heat densities of greater than 35 $mW/\mu m^2$ for heating microsystems.

The microcombustor can be used for other sensor applications in microanalytical systems. A micro-scale flame ionization detector (microFID) is provided by coupling an electrometer circuit with miniature electrodes in the combustion chamber. The microFID of the present invention uses catalytically stabilized combustion on a microhotplate for the flame ionization detection of hydrocarbon ionization from the combustion of fuels. The catalytically stabilized flame con operate over broader combustion limits and at reduced temperatures compared to conventional FIDs. Therefore, the microFID can be used with premixed fuels. The microFID can be used to determine fuel carbon content. For example, the detection of approximately 1–3% of ethane in hydrogen/air is achieved using premixed fuel and a catalytically-stabilized flame. Because the microFID has high sensitivity and selectivity with a minimum response time, it may be useful for real-time monitoring of analytes eluted from a gas chromatography column.

BRIEF DESCRIPTION OF THE DRAWINGS

The accompanying drawings, which are incorporated in and form part of the specification, illustrate the present invention and, together with the description, describe the invention. In the drawings, like elements are referred to by like numbers.

FIG. 7A is for a constant air flow of 40 ml/min. FIG. 7B is for a constant air flow of 5 ml/min.

FIG. 8A shows the response surface for a Pd-alumina catalyst.

FIG. 8B shows the response surface for a Pt-alumina catalyst.

FIG. 10A shows the voltage response using the constant-resistance power supply. FIG. 10B shows the voltage response without using the constant-resistance power supply.

DETAILED DESCRIPTION OF THE INVENTION

Stable flames are difficult to achieve on a small scale due to enhanced heat loss and flame quenching arising from large surface-to-volume ratios. Thermal isolation of a hot combustion zone is achieved in the microcombustor of the present invention by providing a microhotplate having low heat capacity and thermal conductivity. Wall quenching reactions are reduced and the combustion reactions can be enhanced by the use of surface catalysts on the surface of a miniature, electrically heated, thermally isolated membrane of the microhotplate. The surface catalyst enables stable ignition and flame propagation in the submillimetric combustion chamber of the microcombustor. In addition, the surface catalyst can sustain high reaction temperatures, enabling a microcombustor with high durability and lifetime.

Microcombustor

Figure 1:
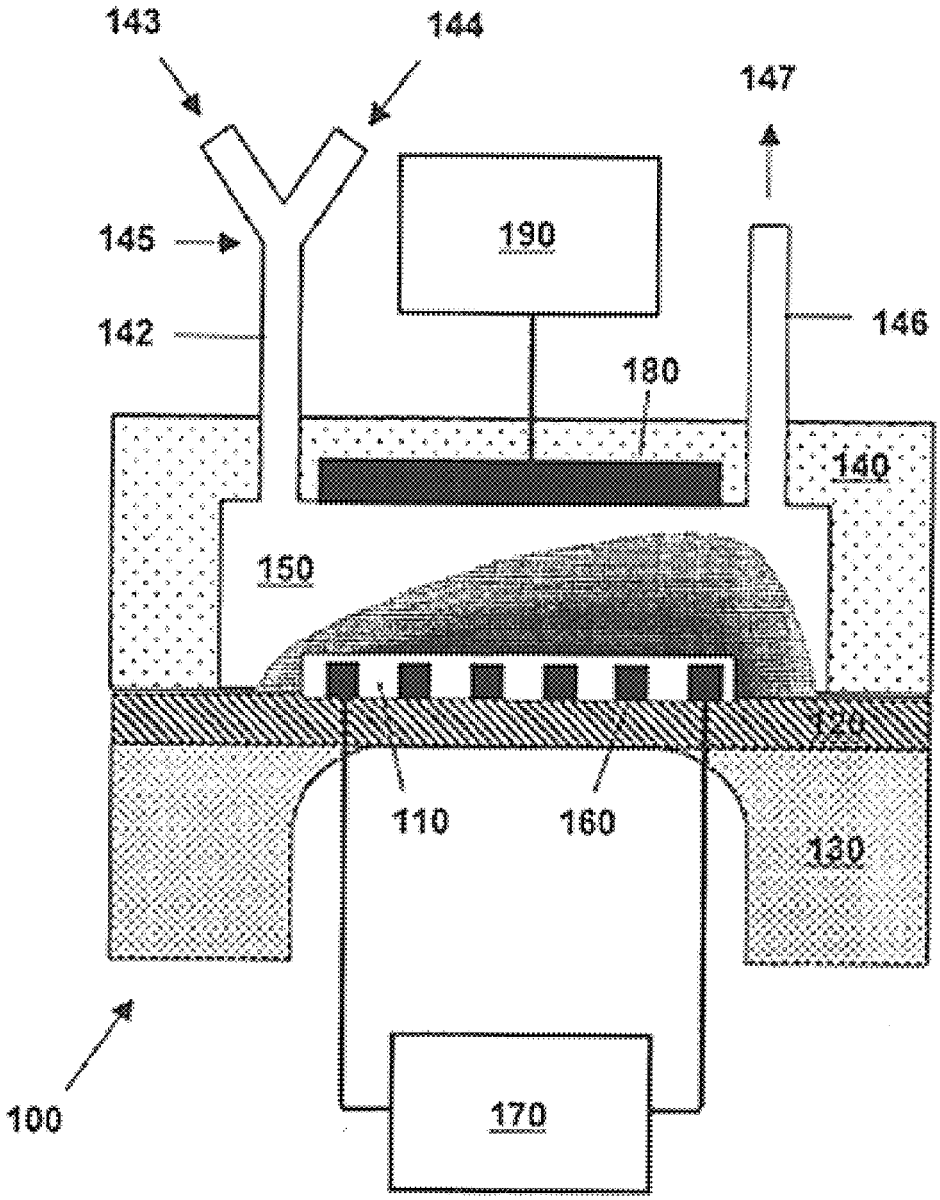
FIG. 1 is a schematic illustration of the microcombustor.

In FIG. 1 is shown the microcombustor 100 of the present invention, comprising a catalyst 110 disposed on a microhotplate comprising a heated membrane 120 that is suspended from a substrate 130. A gas tight lid 140 attaches to the combustion chamber side of the substrate 130 to seal the combustion chamber 150 of the microcombustor 100. For gas-phase, catalytically stabilized flames, the lid preferably comprises a high-temperature material, such as pyrex or ceramic. The lid 140 can have a reactant gas inlet 142 for introduction of the reactant gases into the combustion chamber 150 and an exhaust gas outlet 146 for removal of the gaseous combustion products 147. The reactant gas inlet 142 can further comprise a pre-mixer section 145 for pre-mixing the reactant gases, comprising a fuel 143 and an oxidant 144. Alternatively, the combustion gases can be fed into the combustion chamber 150 through separate gas inlets (not shown). Capillary tubes can be used as the reactant gas inlet 142 and exhaust gas outlet 146. A resistive heating element 160 can be disposed on the combustion chamber side (as shown) or on the opposite side of the membrane 120. The resistive heating element can be resistively heated by electricity supplied by a power supply and control circuit 170. Electrical contact to the resistive heating element 160 can be established with perimeter bond pads (not shown). The perimeter bond pads and thin membrane 120 thermally and physically isolate the resistive heating element 160 and the combustion chamber 150 from the electrical power source 170 and the substrate 130. The combustion chamber can preferably have a diameter of a few millimeters and a height of about 0.15–1 mm.

The microcombustor 100 can be formed by a fabrication method similar to that for the chemical preconcentrator, disclosed in U.S. Pat. No. 6,171,378 to Manginell et al., or the micropyrolyzer, disclosed in U.S. patent application Ser. No. 10/035,537 to Mowry et al., both of which are incorporated herein by reference. This chemical preconcentrator comprises a sorptive material, to selectively sorb one or more chemical species from a gas or vapor over a relatively long time duration, that can be rapidly heated by a resistive heating element to release the sorbed chemical species for detection and analysis in a relatively high concentration and over a relatively short time duration. Unlike the chemical preconcentrator that comprises a sorptive material for sorption and release of a vapor, the microcombustor 100 of the present invention comprises a catalytic material for ignition of the reactant gases and flame stabilization. However, with the exception of the replacement of the sorptive material with the catalytic material, the processing steps of material deposition, photolithography, masking, etching, mask stripping and cleaning required to form the microcombustor 100 are similar to those disclosed by Manginell et al. and Mowry et al. and are generally well-known in the semiconductor integrated circuit (IC) industry.

The fabrication of the microcombustor 100 comprises the steps of forming the suspended membrane 120 on the substrate 130, forming the resistive heating element 160 on the suspended membrane 120, and depositing a catalyst on the suspended membrane. The substrate 130 used to form the microcombustor 100 generally comprises a semiconductor (e.g., silicon or gallium arsenide) or a dielectric (e.g., a glass, quartz, fused silica, a plastic, or a ceramic), with a thickness generally about 400–500 $\mu$m. The suspended membrane 120 is typically formed as a rectangle or polygon with lateral dimensions from about one to a few millimeters on a side (e.g., a square of 1–3 mm on a side), or alternatively as a circle or ellipse with a size from one to a few millimeters. The suspended membrane 120 is supported at its edges by attachment to the substrate 130. The membrane 120 can be sufficiently thick (generally about 0.4–1$\mu$m total thickness) for robustness as required for handling and to support the resistive heating element 160 and the catalyst 110. Additionally, the membrane 120 can be sufficiently robust to withstand any stress induced by a mismatch in thermal expansion coefficients of the membrane 120 and the supporting substrate 130 upon heating to a combustion temperature of over several hundred ° C. Low-pressure chemically vapor deposited silicon nitride is a preferred membrane material due to its low stress, low thermal conductivity, low heat capacity, and compatibility with IC processing steps. The low thermal conductivity minimizes heat loss to the substrate 130 and the low heat capacity enables heating of the combustion chamber 150 to elevated temperatures. Other materials such as polycrystalline silicon, silicon oxynitride, and silicon carbide can also be used to form the membrane 120.

A silicon nitride suspended membrane 120 can be fabricated on a silicon substrate 130 by through-wafer etching of a silicon wafer. Either Bosch etching or KOH etching can be used to release the membrane 120, with no discernable operational differences between the completed devices made by either method. In the case of Bosch etching, an etch stop layer, for example 0.5 $\mu$m thermally-grown oxide, can be used to prevent undesired etching of a 1 low-stress silicon nitride membrane layer. Any residual oxide remaining after the Bosch etch can be stripped in buffered HF. For KOH etching, no additional etch stop layer is required.

Prior to silicon etching by either method, the thin-film resistive heating element 160 can be patterned on the membrane layer on the opposite side of the silicon wafer from the etch window. The resistive heating element 160 generally can comprise one or more circuitous metal traces formed from one or more layers of deposited metals including platinum, molybdenum, titanium, chromium, palladium, gold, and tungsten that can be patterned on the upper (i.e., combustion chamber) side of the membrane 120. Alternatively, the resistive heating element 160 can be patterned on the underside of the membrane 120. To form a platinum resistive heating element 160, a 10-nm-thick adhesion layer of titanium or tantalum, or oxides of these materials, can be deposited on the silicon nitride membrane layer 120 through a patterned photoresist mask having a circuitous opening therethrough, followed by deposition of a 170-nm-thick layer of platinum. The resistive heating element 160 generally covers about 50% of the area of the suspended membrane 120 that forms the combustion chamber 150. The resistive heating element 160 can double as a temperature sensor by monitoring the resistance change of the wire caused by thermal fluctuations. The microcombustor 100 has a high thermal sensitivity of typically better than 0.4 mW/° C. The microcombustor 100 can attain a temperature of 200° C in less than 20 msec.

Figure 2:
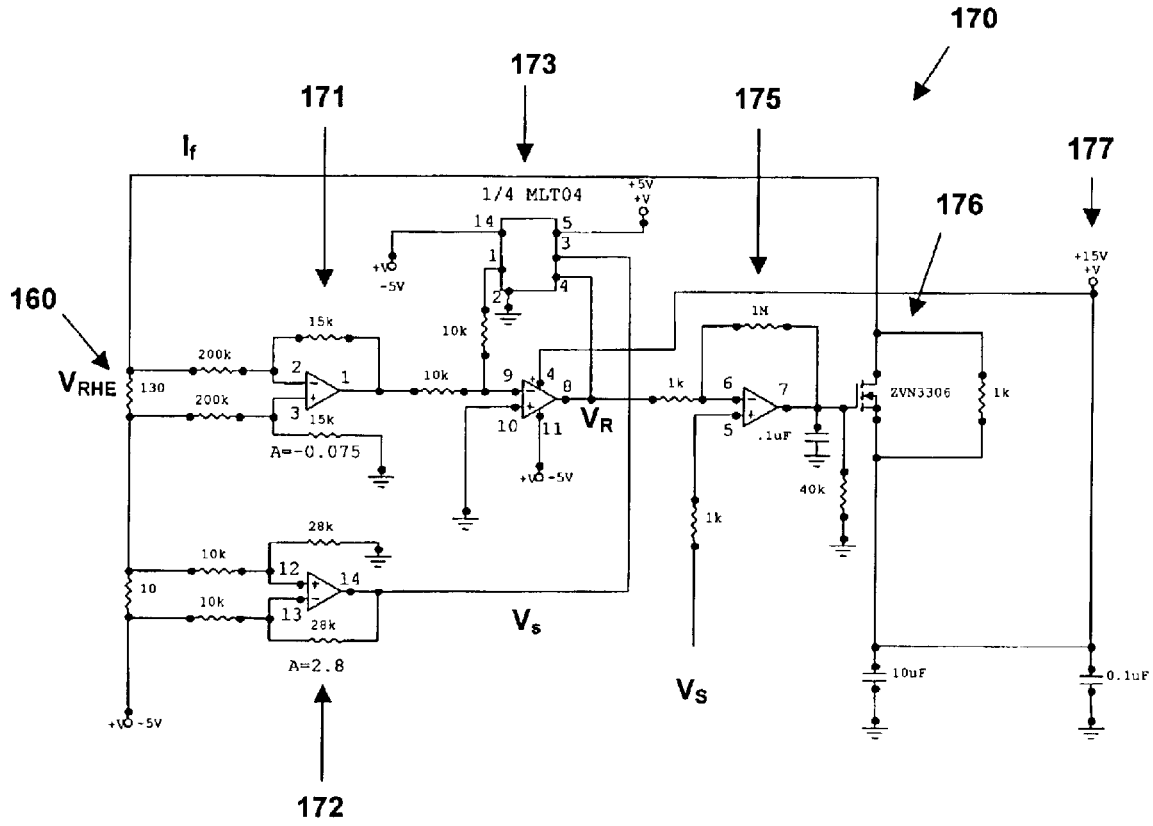
FIG. 2 is a diagram of a circuit for a constant-resistance power supply.

The temperature of the microcombustor 100 can be controlled using a variety of electronic control circuits 170. In FIG. 2 is shown a control circuit for the constant-resistance power supply 170. Since the temperature coefficient of resistance of materials is well known, the temperature is equivalent to the resistance of the resistive heating element 160. The resistive heating element 160 therefore can double as a temperature sensor as well as a microhotplate heater. The feedback control circuit 170 measures the power (via the current and voltage) necessary to maintain the resistive heating element 160 at a programmed temperature. A first operational amplifier 171 measures the voltage $V_{RHE}$ across the resistive heating element 160 (the resistive heating element 160 has a nominal resistance of about 130 ohm). A second operational amplifier 172 produces a voltage $V_I$ that is proportional to the current $I_f$ through the resistive heating element 160. Therefore, the output voltage $V_R$ of divider 173 (e.g., comprised of an Analog Devices MLT04 chip and an operational amplifier) is proportional to the resistance of the resistive heating element 160. Using differential amplifier 175, the output voltage $V_R$ can be compared to a programmed voltage $V_S$. The programmed voltage $V_S$ determines the desired resistance (i.e., temperature) of the resistive heating element 160. The comparator output of the differential amplifier 175 controls the gate of transistor 176 that feeds back to the resistive heating element 160 to maintain the desired temperature of the microcombustor 100. The larger the difference between the divider voltage $V_R$ and the programmed voltage $V_S$, the greater the feedback current $I_f$ that is switched from power supply 177 to the resistive heating element 160. Other circuits of the type known in the electronic control art can be used to control the resistive heating element 160 including using a separate temperature sensor or software control using a computer.

The circuit 170 enables active control of microhotplate by varying the power into the microcombustor's heating element 160 to maintain a set resistance. The set point resistance, and therefore temperature, is user controlled. When external heating from combustion attempts to increase the effective resistance of the heating element 160, the circuit power decreases to compensate. This feedback mechanism maintains constant heating element resistance, and hence constant microhotplate temperature. The magnitude of these fluctuations about the baseline power constitute the measured signal of the temperature sensor and allow direct measurement of the combustive heat collected by the device. The advantages of constant temperature operation include reduced signal variability from temperature fluctuations, longer microcombustor life from a reduction in thermal cycling, and assurance that combustion temperature of the catalyst does not change with the fuel concentration.

Catalyst Preparation

Whereas the platinum heating element 160 itself can be used as a thin-film catalyst, it has been found that the high temperatures (up to 900° C.) reached during combustion can cause premature failure of the heating element 160. At combustion temperatures, the thin-film metallization can fail due to delamination, hotspots and metal agglomeration, induced by metal migration. Also, direct exposure of the thin-film metalization to combustion conditions can result in long-term drift in the heater resistance and catalytic activity.

Therefore, a supported catalyst 110 is preferred for the microcombustor 100 of the present invention. The particular choice of catalyst and operating temperature is dependent upon the application. The catalyst can be, for example, a noble metal, noble metals with additives (e.g., copper), semiconducting oxides, or hexaaluminate materials. The catalyst can be supported in high-temperature-stable, high-surface-area materials, such as alumina, hexaaluminates, zirconia, ceria, titania, or hydrous metal oxides (e.g., hydrous titanium oxide (HTO), silica-doped hydrous titanium oxide (HTO:Si), and silica-doped hydrous zirconium oxide (HZO:Si)). The range of catalyst loading can preferably be about 0.05 to 10 percent by weight. These supported catalysts have good stability and reactivity and help to mitigate against reliability problems and failure modes by insulating the thin-film heater element 160 from the harsh combustion conditions. Alumina-supported catalysts comprising noble metals, such as Pt or Pd, supported in an alumina matrix are commonly used.

The supported catalyst 110 can be disposed on the surface of the heated membrane 120 that is exposed to the combustion chamber 150. The catalyst 110 should preferably be thick enough to provide sufficient catalytic activity, but thin enough to allow for adequate heat transfer between the microhotplate surface and the catalyst surface in contact with gases to be combusted. Reliable deposition of catalysts is highly desirable in order to achieve consistent microcombustor performance. Slurry deposition and chemical vapor deposition have been typically used to deposit supported catalysts in the past. The former method can be used to deposit commercially available catalysts, such as Pt/alumina, but have limited ability to reliably deposit an optimum catalyst thickness.

Preferably, a micropen deposition technique can be used to reliably, and uniformly, deposit the catalyst 110 on the membrane 120. The micropen is a thick-film direct write tool originally designed for precision value thick-film resistors. Micropen printing systems write patterns by dispensing a controlled volume of slurry/paste through a pen tip onto a moving X-Y print table. For example, an Ωhmcraft Micropen 400 printing system can be adapted for catalyst deposition. The micropen dispenses a controllable volume of paste per time, which enables control of thickness by varying print volume, paste concentration, and write speed. Lateral dimensions of the catalyst deposit can be controlled to about +/−5 μm, and the thickness of the dispensed catalyst can range from 5–500 μm +/−5%.

The micropen printing technique allows the controlled deposition of, for example, Pt- and Pd-supported catalysts. Catalysts powders of about 1 wt % Pt/alumina, and 1 wt % Pd/alumina can be prepared for use with the Ωhmcraft Micropen 400 printing system. Other powder mixtures can also be used. The powders can be calcined for 2 hours at 600° C. in air and prepared by incipient wetness. Pastes or "inks" suitable for direct-write printing with the micropen can then be created from the powders. Both aqueous (water+additives) and organic solvent systems can be used to produce the pastes. For aqueous pastes, the powder catalyst can be dispersed in water with a pH adjusted to about pH 4 using nitric acid. A humectant drying inhibitor, such as Avecia Humectant GRB2, can be added to prevent rapid evaporation of the solvent, which might otherwise clog the pen tip between printing runs and cause cracking of the deposited paste during drying. The alumina/water/GRB2 paste can be mixed for 15 minutes in a Nalgene bottle using alumina media to reduce catalyst agglomerate size, using a Specs Mill. Reduction of agglomerate size to about 15 microns provides a smooth paste flow through the micropen tips, which are about 25–300 μm in size. The paste can be partially dried or diluted with water, and milled again until the desired rheology is obtained. The final paste has a weak yield stress and resists flow due to gravity but flows easily under applied pressure, as in the micropen print conditions. Typical pastes can have about 10–30 volume percent solids. The thickness of the catalyst layer is preferably in the range of 25–75 μm. High reproducibility and good adhesion can be obtained with such catalyst layers. Finally, printed catalyst pads can be dried at 100–300° C. to remove the solvent.

Micro Flame Ionization Detector

A flame ionization detector (FID) measures a current generated from hydrocarbon ionization from the burning of carbon compounds in an oxyhydrogen flame to determine carbon content. Commonly, an FID is combined with a separation column and used in gas chromatography analysis to detect the carbon content in analytes eluted from the column. In particular, hydrocarbons give a current response in proportion to the number of carbon atoms (i.e., the rule of equal response per carbon).

A microFID based on the microcombustor 100 utilizes lean premixed fuel and a catalytically stabilized flame. The ignition source in the microFID of the present invention comes not from heating of the gases or a spark igniter, as in the prior art FID devices, but from the catalyst 110 that is heated in the microcombustor 100. The catalyst 110 has the advantages of enabling low-temperature combustion of the gases and promoting stabilization of the flame. The microFID catalytically combusts a stream of hydrogen together with incoming hydrocarbons over the microhotplate. The resulting hydrogen radicals can chemically crack the hydrocarbon molecules at a much lower temperature and over a broader range of fuel/air ratios than with a conventional combustion chamber. The cracking process produces a flow of current between two electrodes in the microFID, which is proportional to the number of carbon atoms in the burning mixture. Therefore, the catalyst not only aids in combustion, but also aids in reduced-temperature (relative to conventional flames) formation of hydrogen radicals, which are necessary for cracking of the hydrocarbons into single carbon fragments (e.g., methane). Since the pyrolytic degradation of hydrocarbons in the flame is otherwise quite low, this cracking step is a critical one in the overall microFID mechanism.

As shown in FIG. 1, when used as a microFID, the microcombustor 100 further comprises an ion collection electrode 180 in the top of the lid 140. The ion collection electrode 180 should be sufficiently large to collect substantially all of the ions generated. The collection electrode 180 can be of a stable, conducting material, such as a metal or a doped semiconductor. The electrode 180 can be a small planar nickel electrode, of approximately 2 mm diameter, embedded in the top of the lid 140 to provide a potential sources for ion collection. Alternatively, the collection electrode can be microfabricated in a micromachined channel placed over the device. A counter electrode 185 can be on the surface of the membrane 120. The counter electrode 185 can be the resistive heating element 160 or a separate electrode (not shown) for isolation of the control circuit 170 and an electrometer circuit 190. The ion collection electrode 180 collects ions generated in the flame plasma and accelerated to the collection electrode 180 by an externally-applied voltage. The applied potential should be sufficiently large to accelerate the ions to the electrodes, yet not so large as to result in arcing or ion multiplication. The electric field can be less than about 200 V/cm. Since the electrode spacing can be less than 0.1 cm., applied voltages of less than 20 V can be used.

Figure 3:
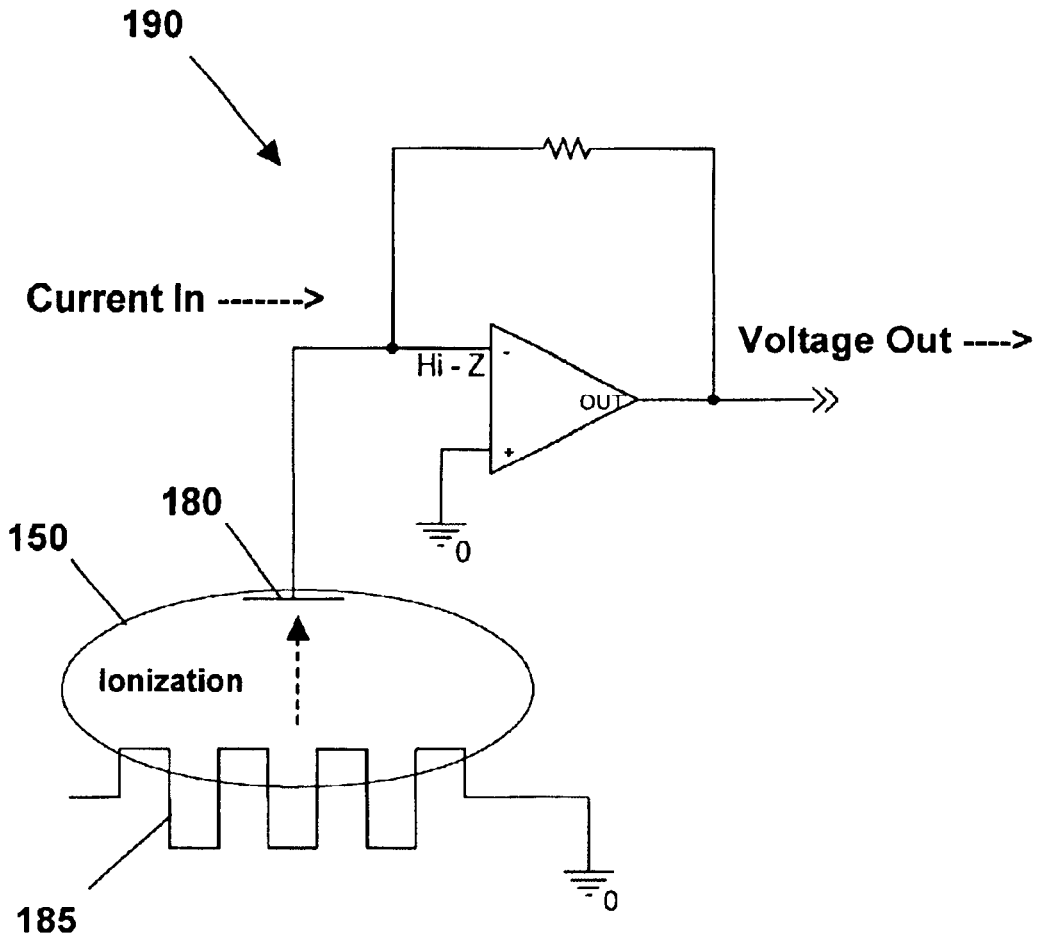
FIG. 3 is a diagram of a micro flame ionization detector.
Figure 4:
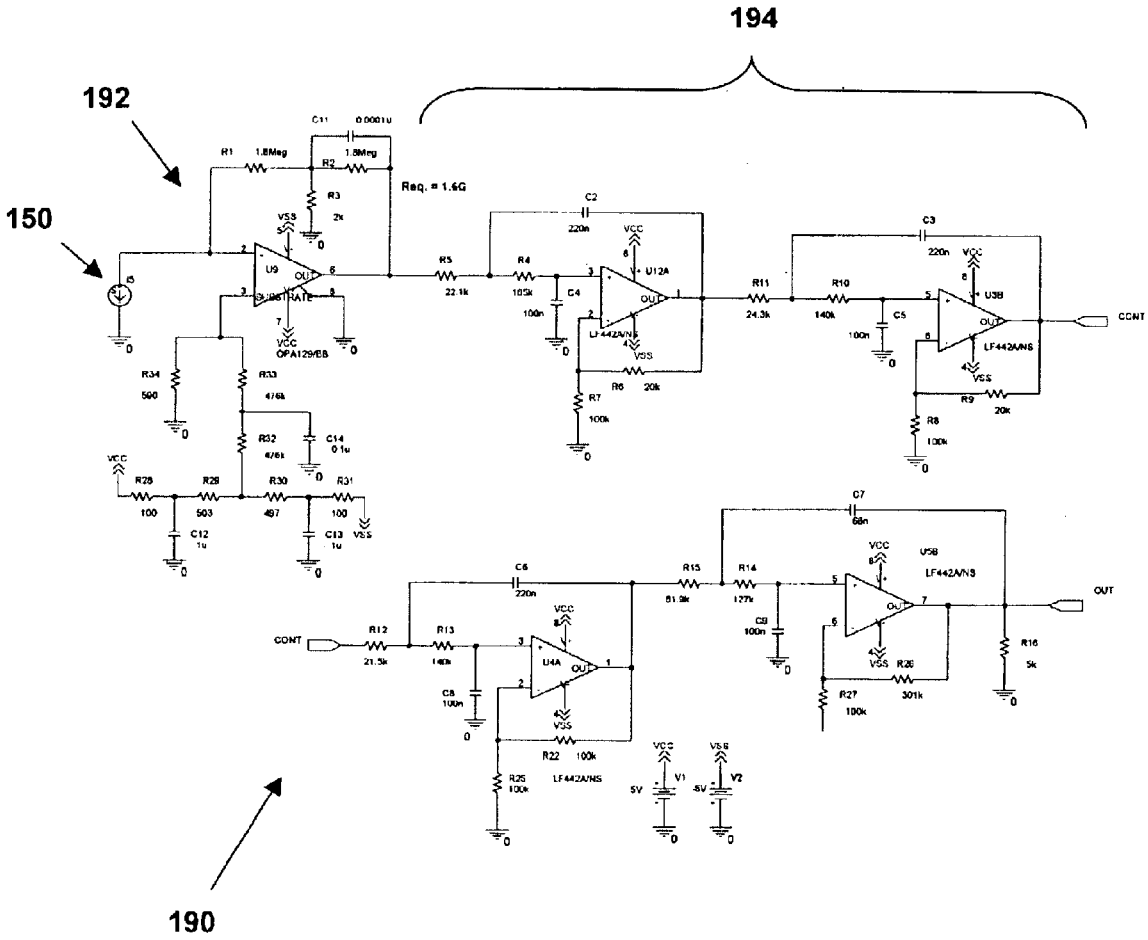
FIG. 4 is a diagram of an electrometer circuit.

As shown in FIG. 3, the microFID can comprise an electrometer circuit 190 to measure the ionization current generated by catalytically stabilized oxyhydrogen combustion of analytes. The electrometer circuit 190 can comprise an operational amplifier that provides an output voltage that is directly proportional to the charge collected by the ion collection electrode 180. A variety of operational amplifiers and filtering schemes can be used to measure the ionization current. As shown in FIG. 4, the electrometer circuit 190 can comprise a Burr-Brown OPA 129 op-amp 192 and $8^{th}$-order Bessel filtering 194 to amplify the ionization current and to filter unwanted noise, including 60 Hz line noise. This electrometer circuit 190 has a gain of 12.5 mWpA. Therefore, a 1.25 V output can be obtained with a 100 pA input.

Testing of the Microcombustor

Tests were conducted to determine the performance of the microcombustor 100 for a variety of combustion gases, flow rates, and combustor temperatures. For these tests, a microcombustor 100 having a combustion chamber volume of about 0.68 $cm^3$ was used. Different concentrations of hydrocarbons, air, and hydrogen were premixed and introduced into the combustion chamber 150 through the reactant gas inlet 142. Hydrocarbons tested include methane, ethane, propane and natural gas. In all of the tests, dry air was used to dilute the hydrocarbon mixtures. Fuel ratios and reactant gas flow rate can be adjusted to provide a stable flame in the combustion chamber 150. The hydrocarbons were in concentrations of 0.8–40% of the total inlet gas composition, at inlet flow gas rates of 5–40 ml/min. The temperature of the microcombustor 100 was set by the power supply 170, and ranged from 83–600° C. in these tests.

Figure 5:
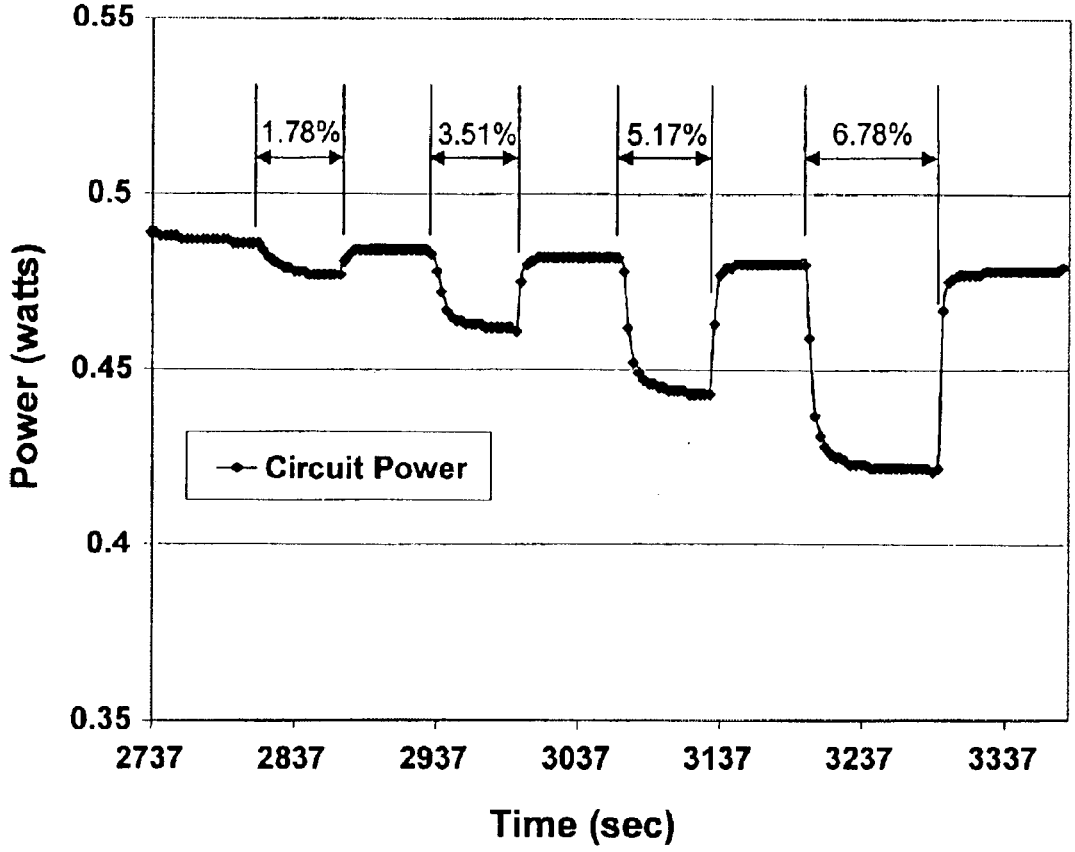
FIG. 5 shows a graph of the power required to maintain the microcombustor at 500 ° C. during the combustion of dilute concentrations of natural gas in dry air on a Pd-alumina catalyst.

In FIG. 5 is shown a graph of the power required to maintain the microcombustor 100 at 500° C. during combustion of 1.78%, 3.51%, 5.17%, and 6.78% concentrations of natural gas in dry air on a Pd-alumina catalyst 110. The constant-resistance circuit 170 maintained the microhotplate at a constant resistance (i.e., temperature) by actively controlling the power to the resistive heating element 160. Fuel combustion heated the microhotplate and, in response, the control circuit 170 reduced the power output to maintain the constant temperature. Hydrocarbon injections into the microcombustor 100 produced an almost immediate change in the power required to maintain the temperature of 500° C. For 1.78% of natural gas, a power change of 7 mW was returned within one minute of the onset of combustion. While the response time of the power supply 170 and the microcombustor 100 was very fast, the hydrocarbon fuel must uniformly fill the combustion chamber 150 before a steady power is established.

Testing has shown that the operating regime of the microcombustor 100 is quite large, and ranged from the low-temperature oxidation of hydrocarbons to full combustion with hydrogen. All of the hydrocarbons tested were successfully combusted. The power change results demonstrate that all hydrocarbons generated detectable amounts of heat down to a thousand ppm or less. Each hydrocarbon exhibited combustion behavior dependent on the flow rate of the inlet gas, microcombustor temperature, and the concentration of the hydrocarbon in the gas stream.

Flames can occur in mixtures only within a certain composition range, given by the limits of flammability (LoF). These tests have also shown that catalytic combustion increases the hydrocarbon LoF. Table 1 summarizes these expanded limits of flammability, expressed as a percentage of fuel in air, by volume. The results shown were valid for both Pd- and Pt-supported catalysts.

TABLE 1

Comparison of conventional and microFID catalytic combustion

| Hydrocarbon | Conventional Limits of Flammability | Catalytically-Stabilized Limits of Flammability |
|---|---|---|
| Natural Gas | 4–16% | 1.3–35.5% |
| Methane | 5–15% | 2–20% |
| Ethane | 2.9–13% | 1–4%* |
| Propane | 2.1–9.5% | 1–11.5% |

*Ethane has not yet been tested beyond the upper limit of flammability.

Modeling and simulation of the ignition/extinction behavior of fuels in the microcombustor confirmed the catalytic extension of LoF despite enhanced microdomain heat losses. The modeling also suggested the possibility of multiple operating points. Simulations with a continuously-stirred reaction model predicted average temperature increases and confirmed the importance of the catalyst surface in microcombustor operation.

Figure 6:
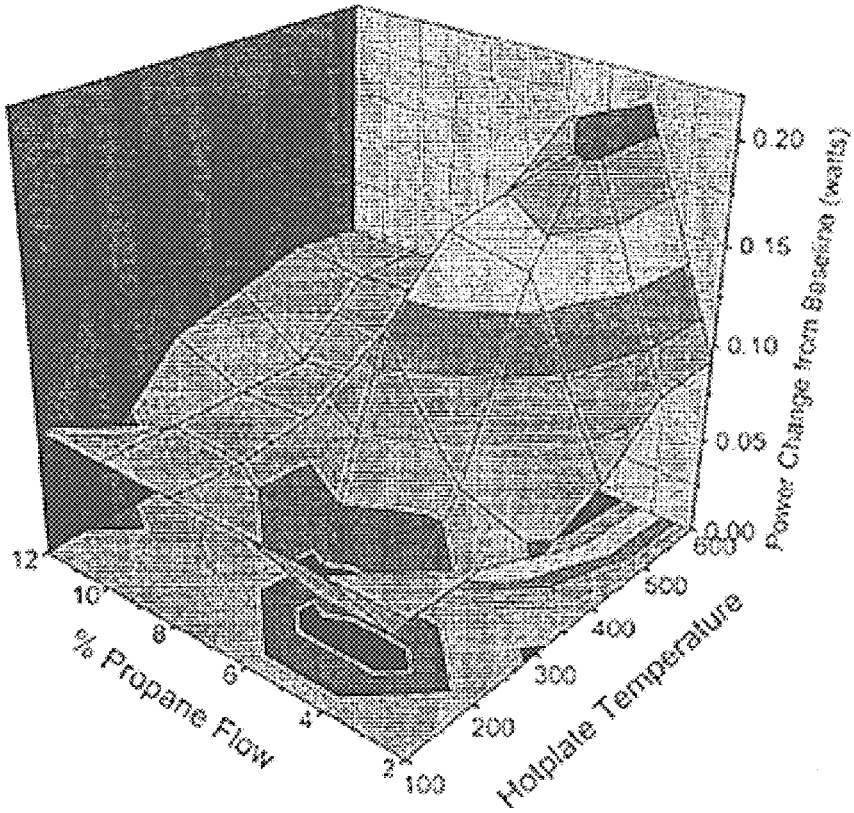
FIG. 6 shows the power response surface for propane as a function of temperature, flow rate, and hydrocarbon concentration.

FIG. 6 shows the power response surface for propane as a function of temperatures, flow rates, and hydrocarbon concentration. In general, there was a strong correlation between the stoichiometric ratio of hydrocarbon to oxygen, and the peak hydrocarbon concentration for combustion. The stoichiometric ratio for propane is 4%, and the concentration of peak combustion for propane in these tests was about 5%. For methane, this stoichiometric ratio is about 10%. The testing indicated that an 11% concentration was optimal for peak combustion of methane. This correlation was valid for high flow rates. In the low flow regime, stoichiometric mixtures can have a smaller power change than non-stoichiometric mixtures. As the flow rate was increased, stoichiometric mixtures begin to dominate. There was also a strong dependence of the power required on the inlet flow rate. Higher flow rates tended to produce larger changes in the power required to maintain a constant temperature. It is likely that at higher flow rates combustion products are swept downstream from the microcombustor more quickly, allowing the catalytic reaction to take place closer to its maximum efficiency. Increases in the microcombustor temperature typically resulted in a larger power change. However at higher concentrations of hydrocarbon, the magnitude of the power change may decrease with increasing temperature. The maximum power change was dependent only on catalyst, not inlet gas velocity or composition.

Differences were observed between the combustion profiles of the Pt and Pd catalysts. According to the literature, a Pd catalyst is sensitive to all hydrocarbons above 400° C., while Pt is sensitive to all hydrocarbons, except methane, at temperatures below this. During natural gas combustion tests it was found that the Pt- and Pd-supported catalysts exhibited slightly different combustion characteristics. These differences can be used to determine the methane content of incoming gases. In general, the platinum catalyst combusted hydrocarbons more effectively over all tested flow regimes, except for the lowest flow rates of 5 ml/min.

Figure 7A:
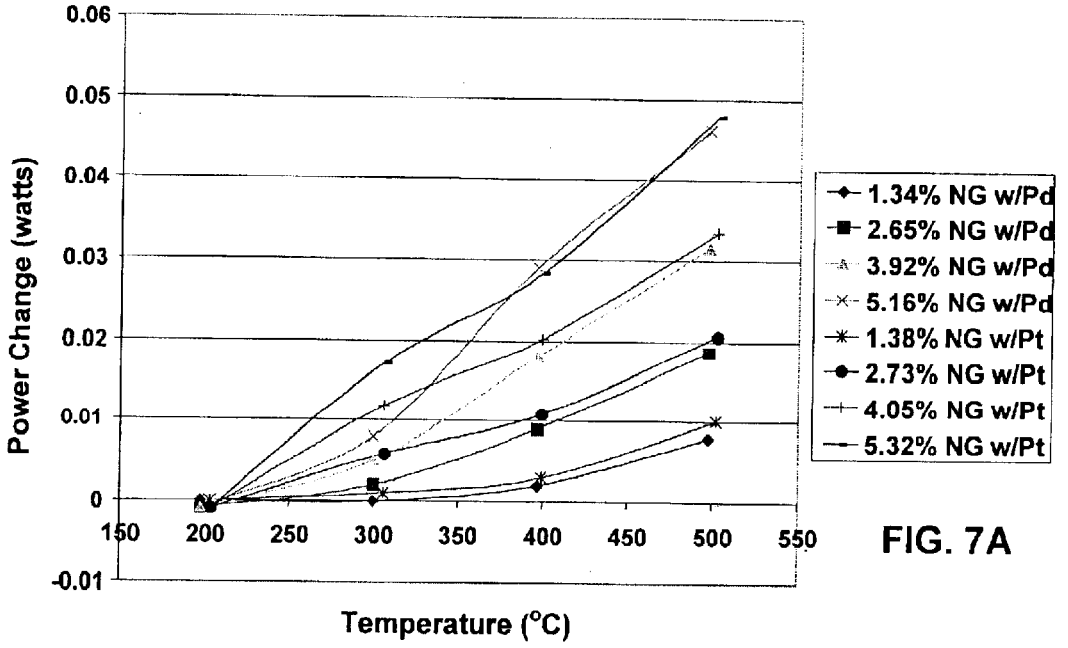
FIGS. 7A and 7B show the power change required to maintain a given temperature for natural gas combustion on Pd- and Pt-alumina catalysts.
Figure 7B:
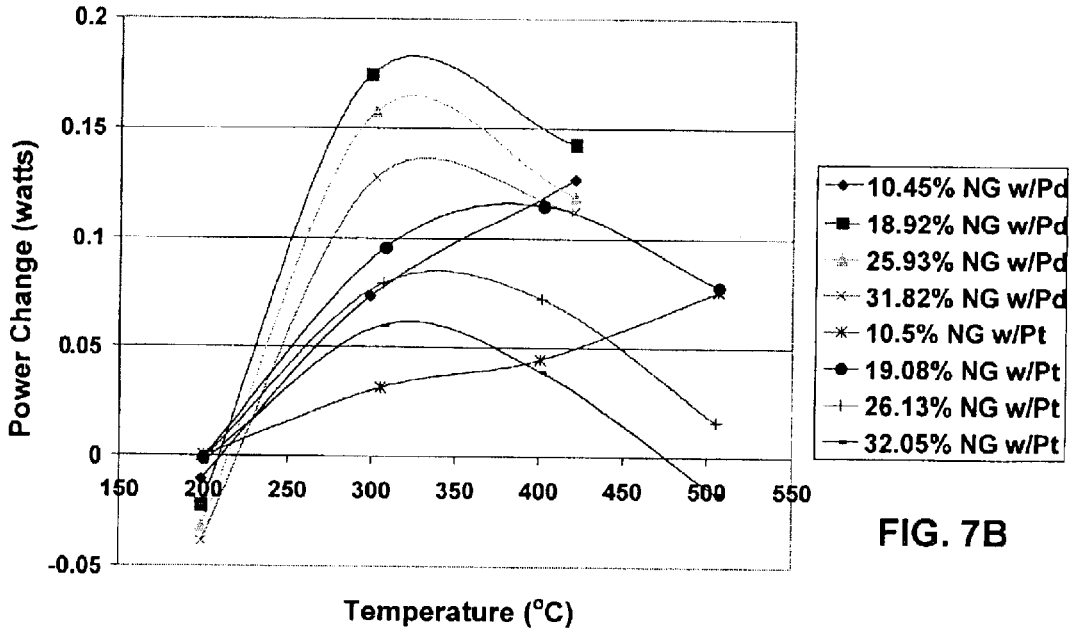

FIGS. 7A and 7B show the power change required to maintain a given combustion temperature of the both the Pt- and Pd-alumina catalysts for the 40 and 5 ml/min air flow, respectively. These figures suggest several modes of combustion. At low temperature, a surface reaction occurs that is reaction-rate limited. Diffusion-limited surface reactions predominate at intermediate temperatures. At the higher concentrations, the power change decreased with increasing temperature, suggesting lift off of the flame.

Figure 8A:
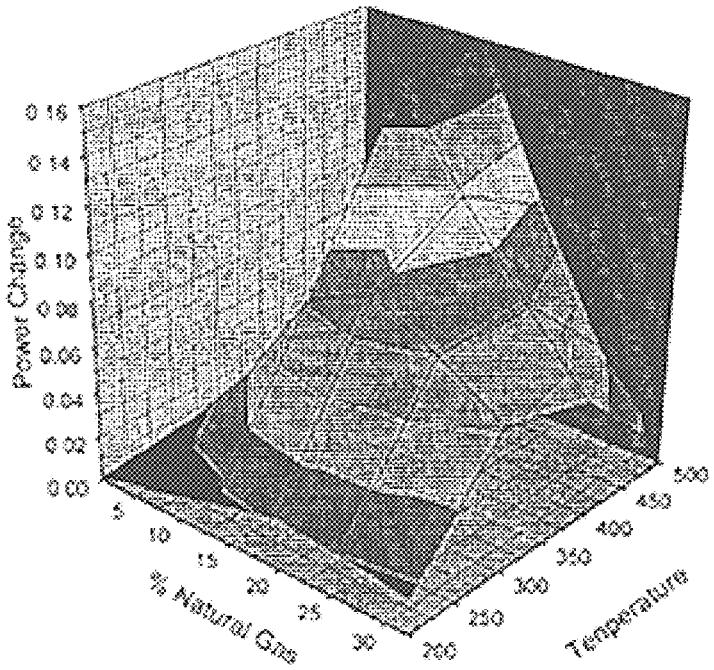
FIGS. 8A and 8B show response surfaces for the catalytic combustion of natural gas.
Figure 8B:
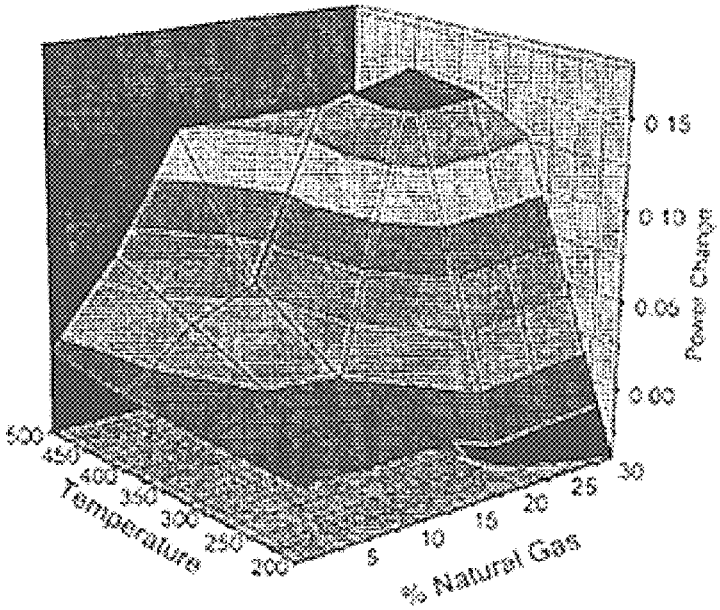

FIGS. 8A and 8B show the response surfaces of natural gas combustion for the Pd- and Pt-alumina catalysts, respectively. These response surfaces can be used to determine the optimum combustion points in terms of natural gas concentration, especially when used in conjunction with catalyst combustion profiles. For example, the response curves can be used to determine the maximum signal differential for hydrocarbon speciation when using a microcombustor having an array of microhotplates for calorimetry. Each element in the array can be held at a different temperature, or with a different catalyst. This allows specific hydrocarbons in a mixture to be selectively, and simultaneous, detected and measured.

Microcombustor for Microsystem Heating

With sustainable combustion comes the option of using the microcombustor 100 for the heating of micro gas chromatography (microGC) columns or other microsystems. Such a portable, handheld microanalytical system based on a microGC is described in Frye-Mason et al., "Hand-Held Miniature Chemical Analysis System ($\mu$ChemLab) for Detection of Trace Concentrations of Gas Phase Analytes," *Micro Total Analysis Systems* 2000, 229 (2000), which is incorporated herein by reference. The microGC typically comprises a 1-meter spiral channel formed in a 1.0–1.5 $cm^2$ area of a silicon chip. Typical channels are 40–100 $\mu$m wide by 300–400 $\mu$m deep. The microGC is typically much larger than other microanalytical systems and, therefore, provides a good test for microsystem heating with the microcombustor 100. Heating of the microGCs is needed to enhance their performance. When compared to conventional batteries, a hydrocarbon combustion scheme allows for a large increase in stored energy to heat a microGC or other microsystem device. Energy density for conventional dry chemistry batteries is extremely low when compared to propane and other hydrocarbon mixtures. A typical high performance lithium ion battery has an energy density of 79.2 J/g, while the equivalent mass of propane would release 46.33 kJ of energy.

Figure 9:
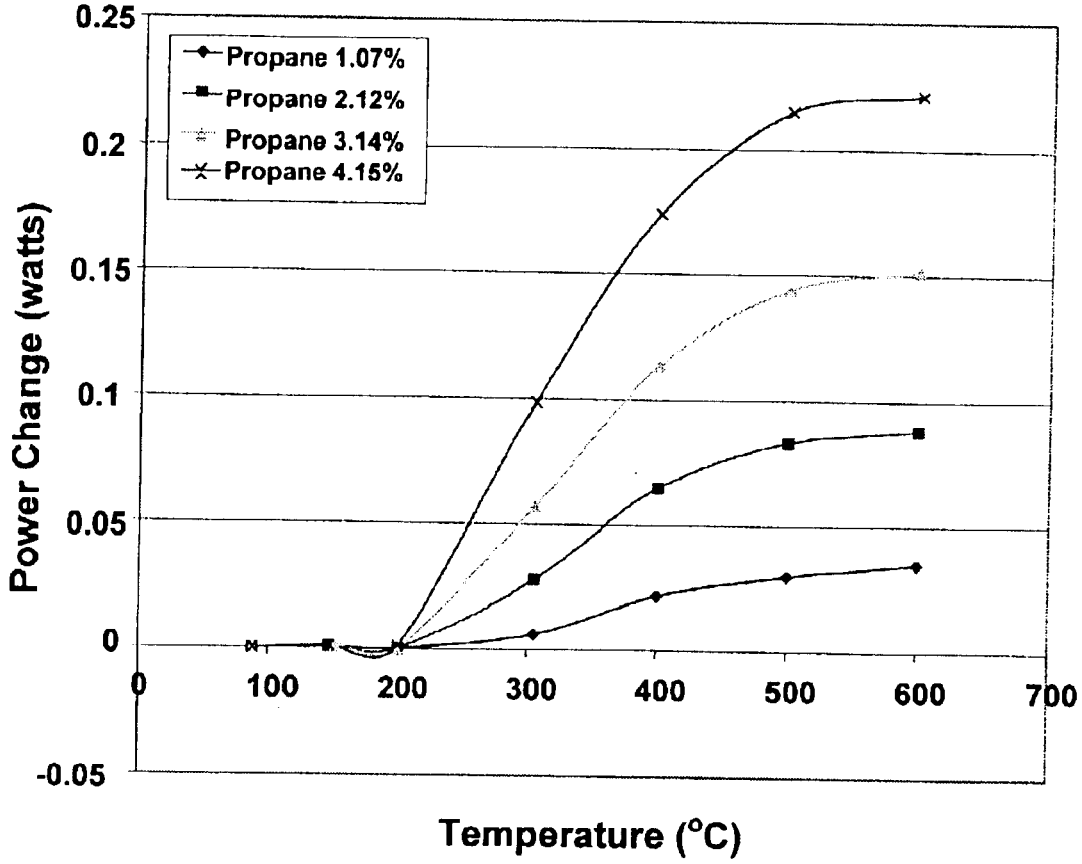
FIG. 9 shows the power change for microsystem heating caused by propane injection into a 30 sccm air flow in the microcombustor.

Because the microcombustor 100 as tested was not optimized for combustion efficiency, a majority of injected hydrocarbons were not combusted during testing and likely blow by the catalyst and flame due to the large combustion chamber volume. FIG. 9 shows the power change caused by propane injections into a 30 sccm air flow. In the 4.15% propane concentration case, the overall efficiency of combustion is only 12.68%. However, the propane combustion still releases 0.221 W, which corresponds to about 35.3 $mW/mm^2$. If a compressed vial of propane gas supplemented the battery power of the $\mu$ChemLab of Frye-Mason et al., then the energy lifetime of the portable microanalytical system could be greatly extended in the field. Even with this inefficient combustion, across a 13×13 mm square silicon die (i.e., the approximate size of the microGC) 5.975 watts of power being applied to the microGC would heat it to 120° C. in about 8.7 seconds. By comparison, the conventional electric heaters on the microGC require 20 volts to supply the 6.8 watts necessary to raise the steady state temperature of the microGC to 120° C. in 7 seconds. These energy requirements for electrical heating of the microGC are already a factor of 10 lower than conventional gas chromatography systems. A small battery can provide the initial heating of the catalyst 110 in the microcombustor 100, but after ignition the catalytic combustion should release enough energy to keep the microcombustor 100 at a high steady state temperature. Propane is a good choice for the hydrocarbon fuel because of its high energy density, availability, and its familiarity to users of the $\mu$ChemLab.

The heating of a microGC column was modeled using a 3-D finite element code. The model consisted of a microGC-sized silicon die, the glass lid 140 of the microcombustor 100 bonded to the die, and Pyrex gas capillary tubes that separated the die/microcombustor from a electrical and fluidic printed circuit board. This setup was identical to that used in the $\mu$ChemLab system of Frye-Mason et al. A uniform heat load of 35.3 $mW/mm^2$, the energy derived from the catalytic combustion of propane in the microcombustor 100, was added to the back of the microGC die. Appropriate boundary conditions were included from thermistor readings taken during experimental microGC heating. This modeling indicated that the microGC can be uniformly heated to a temperature of 120° C. with the microcombustor 100.

Testing of the Micro Flame Ionization Detector

As shown in FIG. 1, the microcombustor 100 can be used as a microFID when an ion collection electrode 180 is embedded in the top of the lid 140. The electrometer circuit 190 shown in FIG. 4 can be used to measure the current generated by catalytically-stabilized oxyhydrogen combustion of analytes. The ionization current is collected when a voltage is applied between the collection electrode 180 and a counter electrode 185 on the surface of the microhotplate. The current is proportional to the number of carbon atoms in the burning mixture, thereby providing a means to measure fuel carbon content.

For the microFID tests, a microcombustor 100 having a 3 mm diameter x 400 $\mu$m high combustion chamber 150 was used. A nickel collection electrode 180 was embedded in a glass lid 140 and a thin-film line was deposited on the membrane 120 to provide a counter electrode 185. The total analyte gas flow was restricted to 60 ml/min. Of this amount, about 11% was composed of hydrogen, ethane comprised 1.16%, 1.74%, 2.3%, or 2.86%, and the balance was dry air. Ethane was chosen as the initial test gas due to the relative ease in cracking as compared with methane. The potential between the collection electrode 180 and the resistive heating element 160 was 20 volts. The resistive heating element 160 had a surface area of 0.17 $mm^2$. A 100 pA collection current gave a 2 V electrometer output. 10 pA steps were discemable and a noise floor of about 1–2 pA was observed.

Figure 10A:
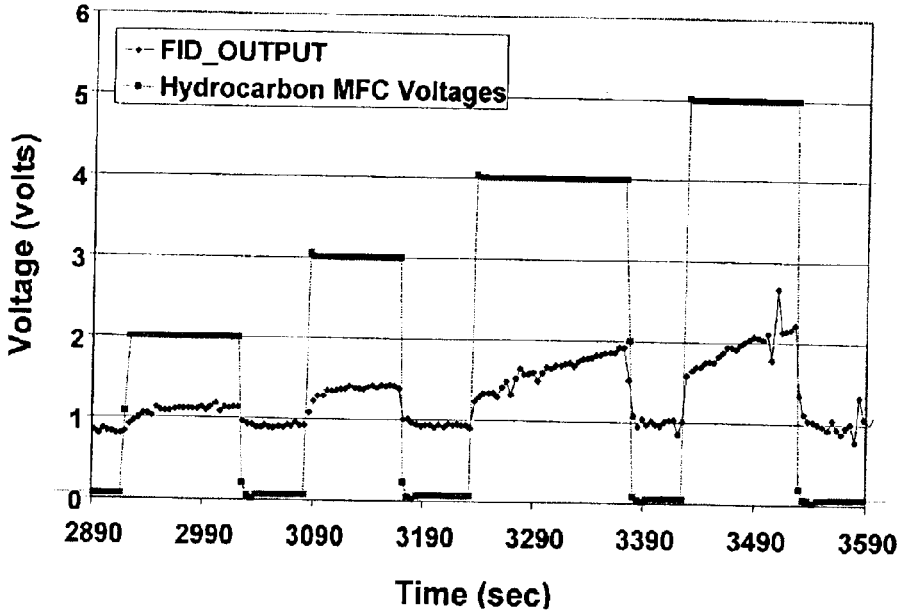
FIGS. 10A and 10B show the voltage response of the microFID to injections of 1.16%–2.86% ethane into the analyte gas flow.

In FIG. 10A is shown the response of the microFID to the sequential 1.16%, 1.74%, 2.3%, or 2.86% injections of ethane into the analyte gas flow. For the tests, the constant-resistance power supply 170 was used to maintain a constant combustion temperature when the analyte gases were fed into the small combustion chamber. Analysis of the microFID data shows good signal fidelity and response time to ethane combustion. The FID output voltage signal increased immediately after analyte injection (indicated by the voltage change to the hydrocarbon mass flow controller, MFC), though a settling time was observe. The voltage change measured by the electrometer 190 during the ethane combustion ranged between 170 mV and 1.19 V, depending on the ethane concentration. Thus, the microFID is reasonably sensitive to ethane concentration, especially considering the low (i.e., 20 V) potential applied to the collection electrode 180, the small surface area of the counter electrode/resistive heating element 160, and the non-uniformity of the potential field caused by the meandering electrode pattern of the counter electrode 185.

Figure 10B:
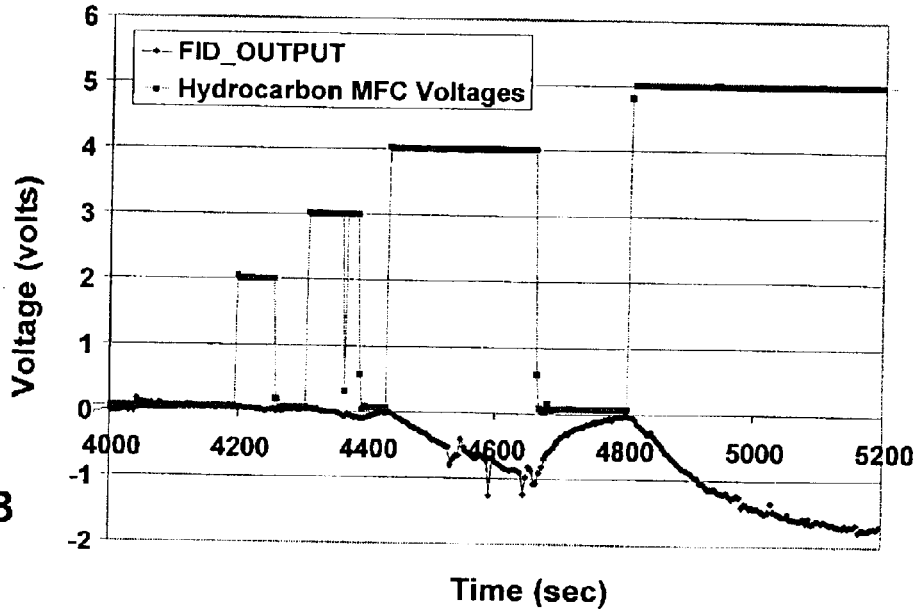

In FIG. 10B is shown the voltage signal after the constant resistance control circuit 170 was turned off. The same range of ethane concentrations, at the same flow rate, was used for these tests as for the tests shown in FIG. 10A. As can be seen in FIG. 10B, the voltage signal sensitivity decreases by about a factor of 3 at the lowest ethane concentrations, likely due to variability in the combustion temperature. With the control circuit 170 turned off, the microcombustor 100 was no longer controlled at a set temperature, and the catalyst 110 likely had large thermal gradients across its surface. As can be seen by comparing FIGS. 10A and 10B, the constant temperature control also increased the speed of the steady-state signal response. Thus, the maintenance of a constant flame temperature is preferred to achieve optimum operational response in the microFID.

The present invention is described as a microcombustor. The use of the microcombustor for thermal management of a microGC column and as a micro flame ionization detector have been described. The microcombustor can be used as a power supply, for on-chip thermal management of Microsystems, and for sensor applications. It will be understood that the above description is merely illustrative of the applications of the principles of the present invention, the scope of which is to be determined by the claims viewed in light of the specification. Other variants and modifications of the invention will be apparent to those of skill in the art.

We claim:

1. A microcombustor, comprising:

a substrate having a suspended membrane formed thereon;

a lid disposed on a side on the membrane to thereby provide a combustion chamber;

at least one reactant gas inlet attached to the combustion chamber for introduction of reactant gases thereinto;

an exhaust gas outlet attached to the combustion chamber for removal of combustion products therefrom;

a resistive heating element disposed on a surface of the membrane for heating of the membrane; and a catalyst disposed on the surface of the membrane exposed to the combustion chamber to provide for ignition of the reactant gases and stabilization of the resulting combustion flame.

2. The microcombustor of claim 1, further comprising a power supply and control circuit for providing electricity to the resistive heating element.

3. The microcombustor of claim 2, wherein the power supply and control circuit comprises a constant-resistance power supply.

4. The microcombustor of claim 1, wherein the substrate is selected from the group consisting of semiconductors and dielectrics.

5. The microcombustor of claim 4, wherein the substrate comprises silicon.

6. The microcombustor of claim 1, wherein the membrane comprises a material selected from the group consisting of silicon nitride, polycrystalline silicon, silicon oxide, silicon oxynitride, and silicon carbide.

7. The microcombustor of claim 1, wherein the resistive heating element comprises a circuitous metal trace.

8. The microcombustor of claim 7, wherein the metal comprises a metal selected from the group consisting of platinum, molybdenum, titanium, chromium, palladium, gold, tungsten, and combinations thereof.

9. The microcombustor of claim 1, wherein the catalyst comprises a supported catalyst.

10. The microcombustor of claim 9, wherein the supported catalyst comprises a catalyst material and a support material.

11. The microcombustor of claim 10, wherein the catalyst material comprises a noble metal, semiconducting oxide, or hexaaluminate.

12. The microcombustor of claim 11, wherein the noble metal comprises platinum or palladium.

13. The microcombustor of claim 10, wherein the support material comprises a high-temperature-stable and high-surface-area material.

14. The microcombustor of claim 13, wherein the high-temperature-stable and high-surface-area material comprises alumina, hexaaluminate, zirconia, ceria, titania, or hydrous metal oxide.

15. The microcombustor of claim 1, wherein the at least one reactant gas inlet comprises a fuel inlet and an oxidant inlet.

16. The microcombustor of claim 1, wherein the at least one reactant gas inlet further comprises a pre-mixer for pre-mixing of the reactant gases.

17. The microcombustor of claim 1, further comprising a microsystem attached to the lid on the side opposite the combustion chamber.

18. The microcombustor of claim 17, wherein the microsystem comprises a micro gas chromatography column.

19. The microcombustor of claim 1, further comprising an ion collection electrode disposed in the combustion chamber opposite a counter electrode, wherein the electrodes collect charge generated by the combustion flame when a voltage is applied between the electrodes.

20. The microcombustor of claim 19, wherein the collection of ions is measured by an electrometer circuit.

21. The microcombustor of claim 20, wherein the electrometer circuit comprises an operational amplifier.

22. The microcombustor of claim 20, when the electrometer circuit comprises a noise-filter.

23. The microcombustor of claim 19, wherein the ion collection electrode is disposed on the lid.

24. The microcombustor of claim 19, wherein the counter electrode is disposed on the membrane.

25. The microcombustor of claim 24, wherein the counter electrode comprises the resistive heating element.

* * * * *

UNITED STATES PATENT AND TRADEMARK OFFICE

CERTIFICATE OF CORRECTION

PATENT NO. : 6,786,716 B1
DATED : September 7, 2004
INVENTOR(S) : Gardner et al.

It is certified that error appears in the above-identified patent and that said Letters Patent is hereby corrected as shown below:

Title page,
Item [75], Inventors, change "Ronald P. Manginelli" to -- Ronald P. Manginell --

Signed and Sealed this

Seventh Day of December, 2004

JON W. DUDAS
*Director of the United States Patent and Trademark Office*